United States Patent [19]

Honegger et al.

[11] Patent Number: 4,539,470

[45] Date of Patent: Sep. 3, 1985

[54] COUNTER APPARATUS FOR COUNTING FLAT PRODUCTS MOVED ALONG A CONVEYING PATH OR THE LIKE

[75] Inventors: Werner Honegger, Tann-Rüti; Hanspeter Bürgi, Salmsach, both of Switzerland

[73] Assignee: Ferag AG, Hinwil, Switzerland

[21] Appl. No.: 437,516

[22] Filed: Oct. 29, 1982

[30] Foreign Application Priority Data

Nov. 10, 1981 [CH] Switzerland ..... 7203/81

[51] Int. Cl.[3] ..... G06M 7/06

[52] U.S. Cl. ..... 235/98 B; 377/8

[58] Field of Search ..... 377/8; 235/98 R, 98 A, 235/98 B

[56] References Cited

U.S. PATENT DOCUMENTS

| | | | |
|---|---|---|---|
| 3,571,574 | 3/1971 | Gerber | 377/8 |
| 3,577,955 | 5/1971 | Palmer | 235/98 B |
| 3,702,925 | 11/1972 | Anderson et al. | 377/8 |
| 4,091,269 | 5/1978 | Schick | 235/98 B |
| 4,139,765 | 2/1979 | Pomey | 235/98 B |
| 4,148,393 | 4/1979 | Wiseman | 235/98 B |

*Primary Examiner*—John S. Heyman

*Attorney, Agent, or Firm*—Werner W. Kleeman

[57] ABSTRACT

A product counter apparatus is disclosed comprising a support element which bears against the products, typically printed products, which are to be counted. A holder device is mounted at the support element. Secured to such holder device is a substantially L-shaped spring or resilient element containing two leg members. The one leg member of such resilient or spring element extends substantially transversely with respect to a predetermined conveying direction of the printed products and protrudes by means of its free end past the holder device. The other leg member of the resilient or spring element is clamped at its end, and thus, can be elastically deflected transversely to a plane containing the printed products. Retained in the holder device is an inductive proximity switch. The printed products moving past the counter apparatus impact at their leading edge at the end of the one leg member which serves as a feeler or sensor and deflect the latter in their product conveying direction. At the same time the feeler is raised while there is deflected the other leg member of the resilient or spring element. Consequently, it is possible for the feeler to be released from the printed product engaging thereat and to resiliently return back into its starting position. During approach of the feeler at the proximity switch the latter generates a counting signal which is inputted to a counter mechanism.

8 Claims, 2 Drawing Figures

COUNTER APPARATUS FOR COUNTING FLAT PRODUCTS MOVED ALONG A CONVEYING PATH OR THE LIKE

BACKGROUND OF THE INVENTION

The present invention relates to a new and improved construction of counter apparatus for counting substantially flat products, especially although not exclusively printed products, preferably moved in an imbricated formation or array along a conveying path or track.

Generally speaking, the counter apparatus of the present development is of the type comprising a feeler or sensor which can be elastically deflected in the conveying direction of the products by means of the leading ends of the products. This feeler coacts with an electric signal transmitter or the like which is responsive to the deflection of the feeler.

According to one such type of prior art construction of counter apparatus, as has been disclosed in German Patent Publication No. 2,446,184, and the cognate U.S. Pat. No. 4,091,269, granted May 23, 1978, the feeler is arranged between two loading disks which bear upon the product stream and possesses a nose member affixed to a spring-elastically deflectable support arm. In the rest position of the feeler, where the support arm bears against an inductive proximity switch, the nose member protrudes at a location beyond the circumference of the loading disks at a position which is located higher than the lowest point of such loading disks. The support arm is elastically deflected in the conveying direction of the products by means of the products which impact against the nose member by means of their leading edges. As soon as the nose member has been pushed back, by the products engaging thereat, to such an extent that it disappears between the loading disks this product is downwardly deflected by such loading disks. Consequently, the nose member releases from the product and the support arm can spring back into its rest position towards the proximity switch. The thus generated counting signal is delivered to a counter mechanism or counter.

With this prior art counter apparatus there is thus required a deflection of the products out of their conveying plane, in order to cause a release of the nose member and to render possible a return-positioning of the support arm. Apart from the thus required considerable expenditure in equipment this proposal is afflicted with the further drawback that such deflection movement, particularly when processing thin products, can result in damage thereto.

Additionally, there is known to the art from U.S. Pat. No. 3,219,829, granted Nov. 23, 1965, a counter apparatus wherein the feeler is pivotably arranged about an axis extending parallel to the plane of the products. This feeler is deflected against the force of a spring by the action of the leading edges of the products which inbound thereat. During such pivoting or rocking of the feeler a light beam of a light barrier or photoelectric arrangement is interrupted and thus generates a counting pulse which is inputted to a counter mechanism. With this prior art design what has been found to be particularly disadvantageous, apart from the unavoidable friction in the bearings of the feeler, is the relatively large inertia which can lead to faulty counts, particularly in the case of products arriving at a close mutual spacing and/or with the large conveying speeds which are encountered. Additionally, this counter apparatus is only suitable for products whose thickness does not fall below a minimum value. The deflection movement of the feeler which is caused, for instance, by one or two individual sheets, is not capable of positively interrupting the light beam of the light barrier and thereafter to again free such light beam.

In the counter apparatus disclosed in U.S. Pat. No. 4,139,765, granted Feb. 13, 1979 a feeler is continuously pressed from below, by the action of spring force, against the products which bear against one another in an imbricated product formation such that each product reposes upon the preceding product. Hence, the trailing edges of the products bear freely at the underside of the product stream which is scanned by the feeler. In order to ensure for a faultless contact of the feeler with the products it is necessary to provide above the product stream a contact or press roll located opposite the feeler.

The feeler is connected with a piezoelectric transducer which delivers a continuous signal in accordance with the contour of the product stream and the unevenness of the individual products. For counting the products there are evaluated those signals which are produced by the feeler ' following travel over the trailing edges of the products and the amplitude of which is greater than the remaining signals. These remaining signals must be filtered-out in order to obtain a correct count of the products.

Due to the deflection amplitude of the feeler which is limited in magnitude, this counter apparatus is not readily suitable for counting the products because of the steps which are formed by the leading edges of the products, since these steps are relatively high, particularly in the case of thick products, and possess a steep ascent. This counter apparatus therefore cannot be arranged at the top surface of an imbricated product stream where the leading edges of the products are located at the top, as such is normally the case when processing printed products.

SUMMARY OF THE INVENTION

Therefore, with the foregoing in mind it is a primary object of the present invention to provide an improved construction of product counter apparatus which is not associated with the aforementioned drawbacks and limitations of the prior art constructions heretofore discussed.

Another and more specific object of the present invention aims at the provision of a new and improved construction of a counter apparatus of the previously mentioned type, which is capable of reliably and faultlessly counting products possessing different thicknesses, especially also thin individual sheets, and wherein the counting operation can be faultlessly carried out even then when such products are moved past at a great velocity and with a small mutual spacing from one another.

Yet a further significant object of the present invention is directed to a new and improved counter apparatus for counting products in a highly reliable, accurate and efficient manner, which counter apparatus is relatively simple in construction and design, quite economical to manufacture, not readily subject to breakdown or malfunction, and requires a minimum of maintenance and servicing.

Now in order to implement these and still further objects of the invention, which will become more readily apparent as the description proceeds, the counter apparatus of the present development is manifested by the features that, the feeler is elastically displaced back by that product which deflects the feeler and in a direction essentially transversely with respect to the plane containing such product.

Thus, the feeler is always deflected by the product engaging thereat not only in the direction of movement or travel of such product, but also is upwardly displaced or shifted. Consequently, the feeler can effectively release from the leading edge of the product and again spring back into its starting position where it is ready to detect or sense the next successive product. Since the lifting of the feeler is accomplished against the action of resilient or spring-elastic forces, the feeler beneficially remains in contact with the products, so that there is reliably avoided any jumping away of the feeler from the products or, in fact, that the feeler will jump over the leading edge of a product.

If the feeler or sensor is constructed as a blade or leaf spring, which is connected with a support element or device which is likewise constructed as a blade or leaf spring, with the feeler being deflectable transversely to the plane containing the products, then there is advantageously obtained a construction which is particularly of low inertia. Preferably, the feeler and its holder device constitute a one-piece construction, wherein the feeler and holder device conjointly form a substantially L-shaped component.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
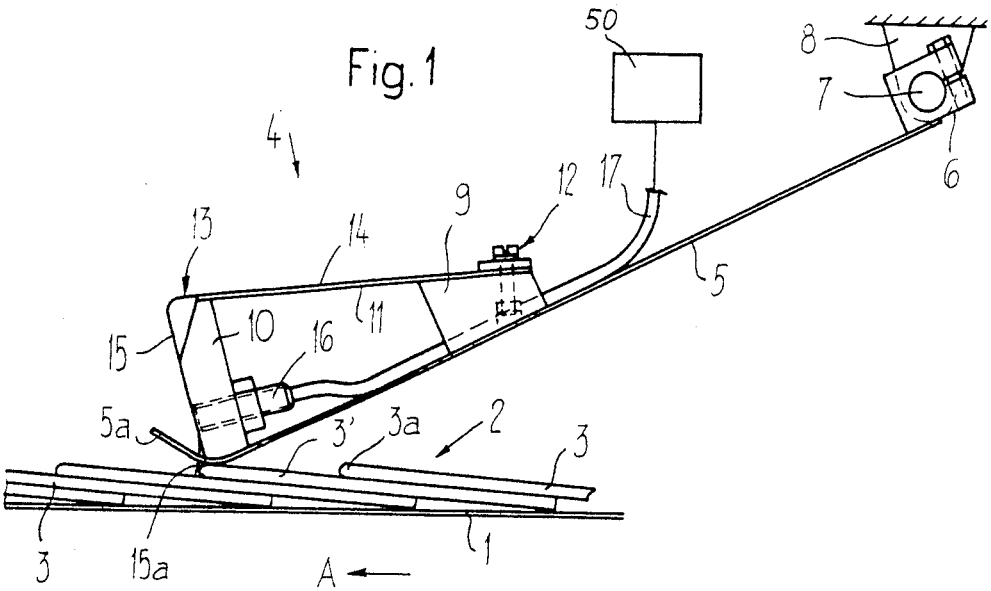
FIG. 1 is a schematic side view of a counter apparatus constructed according to the invention.

Describing now the drawings, it is to be understood that in order to simplify the illustration thereof there has conveniently only been depicted enough of the construction of the exemplary embodiment of counter or counting apparatus as needed for those skilled in the art to readily understand the underlying principles and concept of the present development. Turning attention now specifically to FIGS. 1 and 2, there will be recognized that a suitable conveyor device 1, here shown in the form of a schematically depicted belt or band conveyor which constitutes a conveying path or track for the products 3, here assumed to be printed products which arrive in an imbricated product formation or stream 2. The belt or band conveyor 1 transports the arriving printed products 3 in the direction of travel generally indicated by the arrow A. These printed products 3 bear upon one another in an imbricated configuration or array, much in the manner of overlapping tiles of a roof, and the leading edges 3*a* of the printed products 3 are freely exposed.

Above the product stream 2 there is arranged a counter or counter apparatus, generally designated by reference numeral 4, and constructed according to the teachings of the present invention. This counter apparatus 4 is provided with a support element or device 5 which is constituted, for instance, by a blade or leaf spring or equivalent structure. The support element or device 5 is connected at one end with a suitable clamping or fixing device 6, by means of which this support element or device 5 can be fixedly clamped upon a bolt member 7 of a stationary holder 8. The free end 5*a* of the support element or device 5 is flexed in the manner of a runner and bears against the printed products 3. Secured to the support element or device 5 are two holder elements 9 and 10 which are interconnected by means of a connection element 11 and define a holder device 9, 10, 11. There is secured to the holder element 9 a substantially L-shaped resilient or spring element 13 by means of a thread bolt connection 12 or equivalent fastening expedients. This substantially L-shaped spring element 13 bears, in its rest position, by means of its one leg member 14 at the connection element 11 and by means of its other leg member 15 at the holder element 10, as the same has been clearly shown in FIG. 1. The leg member 15 of the resilient or spring element 13 protrudes at its one free end 15*a* beyond the holder element 10 and the support element or device 5 and serves as a feeler or sensor for the reliable detection of the individual printed products 3 which are moved past the counter apparatus 4. The leg member 14 of the resilient or spring element 13, which is effective in the manner of a blade spring which is clamped at one side or end in the aforedescribed manner, serves as a support or carrier member for the feeler 15 which likewise is constructed in the manner of a blade or leaf spring. Hence, in the description to follow the leg member 14 will be sometimes referred to as the support member, whereas the leg member 15 will be sometimes referred to as the feeler or sensor.

Retained in the holder element 10 is an inductive proximity switch 16 of conventional construction. The pulses generated by this proximity switch 16 in a manner still to be described in greater detail hereinafter, are inputted by means of a connection cable 17 to a merely schematically illustrated counter mechanism or counter 50 which is likewise of conventional design.

Figure 2:
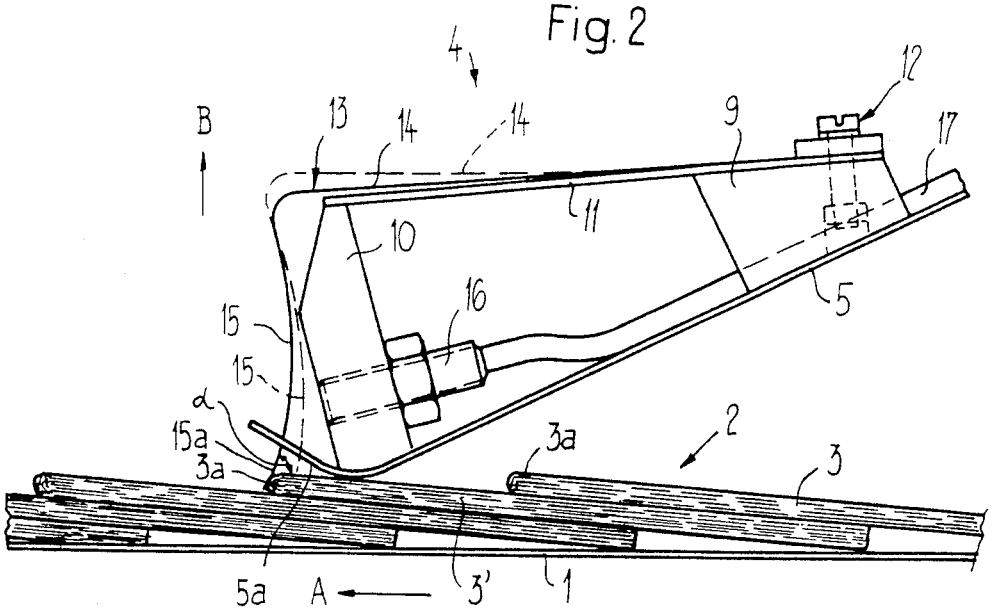
FIG. 2 is a detailed showing of the front portion of the counter apparatus depicted in FIG. 1, portrayed on an enlarged scale in relation thereto.

Having now had the benefit of the foregoing description of the exemplary embodiment of product counter apparatus its mode of operation will be considered and is as follows:

The printed products 3 which are moved past the counter apparatus 4 in the transport or travel direction indicated by the arrow A, impact by means of their leading edges 3*a* against the free depending end 15*a* of the feeler 15, as such as has been illustrated in the drawings of FIGS. 1 and 2 in conjunction with the printed product designated by reference numeral 3'. This free end 15*a* of the feeler 15, which in the rest position of such feeler or sensor extends approximately at right angles to the plane containing the products 3, is entrained by the printed product 3' engaging thereat. This causes a deflection of the feeler or sensor 15 in the transport direction A of the printed products 3, as the same has been illustrated in FIG. 2. Consequently, the angle $\alpha$ between the feeler end 15*a* and the plane of the product 3' is reduced in size, and specifically in the exemplary embodiment under discussion this angle $\alpha$ becomes smaller than 90°. Thus, there is now effective at the feeler or sensor 15 an upwardly directed force component by means of which the feeler 15 is raised in upward direction. Since the feeler 15 is connected with the support member 14 formed by a bendable or flexural spring, which is elastically deflectable in a direction extending substantially transversely to the plane containing the printed products 3, i.e., in the direction of the arrow B, this support member 14 is bent or flexed-out during such raising of the feeler or sensor 15. After moving through a certain deflection path the feeler 15 releases from the front edge 3*a* of the printed product 3', and owing to its spring-elastic properties springs back into its starting position where it bears against the holder element 10. In FIG. 2 there has been illustrated in broken or phantom lines the feeler 15 and the support member 14 during such springing-back action. When the metallic feeler or sensor 15 approaches the inductive proximity switch 16 the latter generates a counting or count signal or pulse which is inputted for further processing to the counter mechanism or counter 50 by means of the connection cable 17 or equivalent structure. The feeler 15 which is located in its starting position is now ready for counting the next printed product 3, during which time it is again deflected in the already described manner.

Since the feeler 15, during its deflection, is raised against the resilient or spring action of the support member 14, it will be appreciated that the feeler 15 also remains in contact with the printed product 3' also during its release from such printed product 3', specifically the leading edge 3*a* thereof. A jumping-off of the feeler 15 from the products 3 or even a jumping of the feeler 15 over the leading edge 3*a* of the next following or successive product 3 is therefore effectively prevented in this manner. It is for this reason that it is possible with the described counter apparatus 4 to faultlessly and correctly count both thick and also thin products, i.e., also individual sheets.

Due to the spring-elastic properties of the support element or device 5 its front end 5*a* can follow the contour of the imbricated product stream 2, without damaging the printed products 3. Additionally, this support element or device 5 which bears upon the printed products 3 with a certain pressure prevents any bowing or bending-out of the printed product 3' impacting against the feeler or sensor 15. By means of the clamping device 6 it is possible to appropriately adjust the inclination of the support element or device 5 in accordance with the thickness of the printed products 3 and the desired contact pressure.

By virtue of the fact that the support member 14 and the feeler 15 are formed of one-piece or integrally with one another from blade or leaf springs there is obtained a particularly simple construction of low inertia. Under circumstances it can be advantageous to dampen the feeler 15 and/or the support member 14. This can be accomplished in a simple manner, for instance by adhesively bonding a suitable material, for instance a foamed plastic to the feeler 15 and/or the support member 14.

It is conceivable to design the support member 14 differently than has been illustrated by way of example, in order to retain the leg member or finger-like leg 15 so as to be elastically movable in the direction of the arrow B. However, such solutions would have, in contrast to the illustrated exemplary embodiment, the drawback that such would constitute a more complicated construction which, under circumstances, also would possess a greater inertia, something which is basically not desired.

Instead of providing the support element or device 5, there also could be used a different support arrangement for supporting the counter apparatus 4 upon the printed products 3. In certain instances it is even possible to totally dispense with the use of such support arrangement for the counter apparatus 14 and to fixedly arrange such above the product stream 2. However, a different type of design would require an elevational adjustment facility for the counter apparatus 4 in the event that there is encountered a change in the thickness of the products which are to be counted.

It should be understood that with the described counter apparatus 4 it is also possible to count other flat products or structures than printed products. Additionally, it is not absolutely necessary that the products which are to be counted are moved in an imbricated production formation 2 past the counter apparatus 4.

While there are shown and described present preferred embodiments of the invention, it is to be distinctly understood that the invention is not limited thereto, but may be otherwise variously embodied and practiced within the scope of the following claims. Accordingly,

What we claim is:

1. A counter apparatus for counting substantially flat products, especially printed products, which are moved along a conveying path in a predetermined product conveying direction, comprising:

a single elastically deflectable feeler having a free end;

said free end, in a rest position of said single elastically deflectable feeler, protruding into said conveying path of said substantially flat products;

said single elastically deflectable feeler protruding past a top surface of an oncoming substantially flat product and being elastically deflectable in and displaced substantial transversely to said predetermined product conveying direction by the entrainment of said free end of said single elastically deflectable feeler by a leading edge of each one of said substantially flat products without the need to deform said products in their conveying path;

said free end, in deflected positions of said single elastically deflectable feeler, forming an angle smaller than 90° with said top surface of said substantially flat product entraining said free end; and an electrical signal transmitter responsive to movement of said single elastically deflectable feeler.

2. The counter apparatus as defined in claim 1, further including:

a support member at which there is supported said feeler; and said support member comprising a bendable spring deflectable in a direction which extends substantially transversely to the plane containing the products.

3. The counter apparatus as defined in claim 2, wherein:

said support member is constituted by a blade spring defining said bendable spring; and means for clamping said blade spring at one end thereof.

4. The counter apparatus as defined in claim 1, wherein:

said elastically deflectable feeler is constructed as a blade spring.

5. The counter apparatus as defined in claim 3, wherein:

said elastically deflectable feeler is constructed as a blade spring; and said elastically deflectable feeler and said support member each form a leg member of a substantially L-shaped spring element.

6. The counter apparatus as defined in claim 1, further including:

a support device with which there are connected said elastically deflectable feeler and said signal transmitter; and said support device bearing against said products.

7. The counter apparatus as defined in claim 6, wherein:

said support device comprises a resilient element having opposed end regions;

means for clamping one of the end regions of said resilient element; and the other end region of said resilient element bearing against the products.

8. The counter apparatus as defined in claim 1, wherein:

said signal transmitter comprises an inductive proximity switch.

* * * * *